US008807122B2

(12) United States Patent
Mai

(10) Patent No.: US 8,807,122 B2
(45) Date of Patent: Aug. 19, 2014

(54) TANK VENTING APPARATUS FOR A SUPERCHARGED INTERNAL COMBUSTION ENGINE AND ASSOCIATED CONTROL METHOD

(75) Inventor: Wolfgang Mai, Kronberg (DE)

(73) Assignee: Continental Automotive GmbH, Hannover (DE)

( * ) Notice: Subject to any disclaimer, the term of this patent is extended or adjusted under 35 U.S.C. 154(b) by 377 days.

(21) Appl. No.: 13/259,410

(22) PCT Filed: Mar. 12, 2010

(86) PCT No.: PCT/EP2010/053209

§ 371 (c)(1),
(2), (4) Date: Sep. 23, 2011

(87) PCT Pub. No.: WO2010/108798

PCT Pub. Date: Sep. 30, 2010

(65) Prior Publication Data

US 2012/0031380 A1 Feb. 9, 2012

(30) Foreign Application Priority Data

Mar. 23, 2009 (DE) ..... 10 2009 014 444

(51) Int. Cl.
*F02M 33/04* (2006.01)

(52) U.S. Cl.
USPC ..... 123/520; 123/196 S

(58) Field of Classification Search
USPC ..... 123/511, 516, 518–520, 198 D, 196 S; 73/114.39
See application file for complete search history.

(56) References Cited

U.S. PATENT DOCUMENTS

| | | | | | |
|---|---|---|---|---|---|
| 4,453,522 | A | * | 6/1984 | Salzgeber | 123/502 |
| 4,719,889 | A | * | 1/1988 | Amann et al. | 123/447 |
| 4,811,710 | A | * | 3/1989 | Schmitt et al. | 123/359 |
| 5,269,278 | A | * | 12/1993 | Heinemann et al. | 123/520 |
| 5,474,047 | A | * | 12/1995 | Cochard et al. | 123/491 |
| 5,520,154 | A | * | 5/1996 | Heimberg et al. | 123/499 |
| 5,743,240 | A | * | 4/1998 | Zerrer et al. | 123/518 |

(Continued)

FOREIGN PATENT DOCUMENTS

| | | | | |
|---|---|---|---|---|
| DE | 102006016339 | A1 | 10/2007 | B60K 15/035 |
| DE | 102007040913 | A1 | 3/2009 | F02M 25/08 |
| FR | 2843423 | A1 | 2/2004 | F02M 25/08 |

OTHER PUBLICATIONS

International PCT Search Report, PCT/EP2010/053209, 14 pages, Jun. 29, 2010.

*Primary Examiner* — John Kwon
*Assistant Examiner* — Johnny H Hoang
(74) *Attorney, Agent, or Firm* — King & Spalding L.L.P.

(57) ABSTRACT

A tank venting apparatus for a supercharged internal combustion engine (1) has a fuel tank (18), a fuel vapor reservoir (25) connected to the fuel tank (18) via a connecting line (26) and to an intake pipe (9) of the internal combustion engine (1) via a venting line (27), a tank venting valve (28) which is arranged in the venting line (27), and a safety valve (33) which is arranged in the venting line (27) between the tank venting valve (28) and the intake pipe (9). The safety valve (33) is configured so as to permit a gas flow in a blocking direction (S) from the intake pipe (9) to the tank venting valve (28) with a certain positive pressure in relation to the pressure at the tank venting valve (28) is achieved in the intake pipe (9).

15 Claims, 3 Drawing Sheets

(56) References Cited

U.S. PATENT DOCUMENTS

| | | | | |
|---|---|---|---|---|
| 6,223,732 | B1 * | 5/2001 | Isobe et al. | 123/520 |
| 6,227,176 | B1 * | 5/2001 | Hettmann | 123/516 |
| 6,260,544 | B1 * | 7/2001 | Spry et al. | 123/516 |
| 6,382,017 | B1 * | 5/2002 | Majkowski et al. | 73/49.7 |
| 6,591,794 | B2 * | 7/2003 | Toda | 123/73 A |
| 7,069,915 | B2 * | 7/2006 | Brandenburg et al. | 123/516 |
| 7,400,955 | B2 | 7/2008 | Baumann et al. | 701/29 |
| 7,448,257 | B2 * | 11/2008 | Kimura | 73/49.7 |
| 8,042,522 | B2 * | 10/2011 | Achor et al. | 123/516 |
| 2004/0025851 | A1 | 2/2004 | Krimmer et al. | 123/522 |
| 2004/0237946 | A1 | 12/2004 | Murakami et al. | 123/520 |
| 2006/0272400 | A1 * | 12/2006 | Wakahara | 73/118.1 |
| 2009/0120413 | A1 * | 5/2009 | Ramamurthy et al. | 123/511 |
| 2011/0030839 | A1 * | 2/2011 | Lohmann et al. | 141/4 |
| 2011/0197864 | A1 * | 8/2011 | Karcher | 123/574 |

* cited by examiner

TANK VENTING APPARATUS FOR A SUPERCHARGED INTERNAL COMBUSTION ENGINE AND ASSOCIATED CONTROL METHOD

CROSS-REFERENCE TO RELATED APPLICATIONS

This application is a U.S. National Stage Application of International Application No. PCT/EP2010/053209 filed Mar. 12, 2010, which designates the United States of America, and claims priority to German Application No. 10 2009 014 444.7 filed Mar. 23, 2009, the contents of which are hereby incorporated by reference in their entirety.

TECHNICAL FIELD

The present invention relates to a tank venting apparatus for a supercharged internal combustion engine, and a control method for this tank venting apparatus.

BACKGROUND

In order to limit the pollutant emissions, modern motor vehicles are equipped with a tank venting apparatus, in which the fuel vapors escaping from the fuel tank are stored. An integral part of the tank venting apparatus is a fuel vapor reservoir, in which the fuel vapors are adsorbed. Once the load limit of the fuel vapor reservoir is reached, the latter must be regenerated by a tank venting operation. For this purpose the fuel vapor reservoir is connected to the inlet manifold of the internal combustion engine by way of a venting line. Arranged in the venting line is a controllable tank venting valve, which is opened for performing the tank venting operation, so that the fuel vapors adsorbed in the fuel vapor reservoir escape into the inlet manifold due to the negative pressure in the latter, and take part in the combustion. Accordingly a tank venting operation is possible only when a negative pressure prevails in the inlet manifold relative to the tank venting apparatus. In the case of supercharged internal combustion engines, in the supercharged operating state a higher pressure prevails in the inlet manifold than in the tank venting apparatus. In order to protect the tank venting valve, therefore, a safety valve in the form of a non-return valve is often arranged in the venting line between the tank venting valve and the inlet manifold. This safety valve prevents any gas flow from the inlet manifold in the direction of the tank venting valve and thereby protects the tank venting valve against excessive pressure loading.

Further reaching, statutory provisions prescribe testing of the tank venting apparatus for leaks. One known method, natural vacuum leak detection (NVLD), therefore exploits the natural formation of a negative pressure in the tank venting apparatus during cooling, in order to test the leak tightness. For this purpose the tank venting apparatus usually comprises either a pressure sensor or a pressure switch, which indicate the pressure level in the tank venting apparatus. The working of this pressure switch must be tested in accordance with statutory provisions.

SUMMARY

According to various embodiments, a tank venting apparatus and an associated control method for the tank venting apparatus can be provided, by means of which a function test can easily be carried out on the tank venting apparatus even in the case of supercharged internal combustion engines.

According to an embodiment, a tank venting apparatus for a supercharged internal combustion engine may comprise a fuel tank, a fuel vapor reservoir, which is connected to the fuel tank by way of a connecting line and to an inlet manifold of the internal combustion engine by way of a venting line, a tank venting valve, which is arranged in the venting line, and a safety valve, which is arranged in the venting line between the tank venting valve and the inlet manifold, the safety valve being designed in such a way that it permits a gas flow in a closing direction from the inlet manifold to the tank venting valve, until a specific excess pressure is reached in the inlet manifold relative to the pressure at the tank venting valve.

According to another embodiment, in a method for controlling a supercharged internal combustion engine having a tank venting apparatus as described above, after switching off the internal combustion engine the tank venting valve is opened in such a way that pressure equalization is permitted between the fuel tank and the inlet manifold; the position of a pressure switch is registered, the switch being designed in such a way that on completion of pressure equalization between the fuel tank and the inlet manifold it is situated in a high-pressure switching position; and a defect of the pressure switch is detected if the pressure switch is not situated in the high-pressure switching position after opening of the tank venting valve.

According to a further embodiment of the method, a defect of the pressure switch may be identified only if it is not situated in the high-pressure switching position once a predefined period of time has elapsed following opening of the tank venting valve. According to a further embodiment of the method, the tank venting valve is not opened if the pressure switch is already situated in the high-pressure switching position prior to opening of the tank venting valve.

BRIEF DESCRIPTION OF THE DRAWINGS

The invention will be explained in more detail below with reference to the figures attached, in the figures.

DETAILED DESCRIPTION

Figure 1:
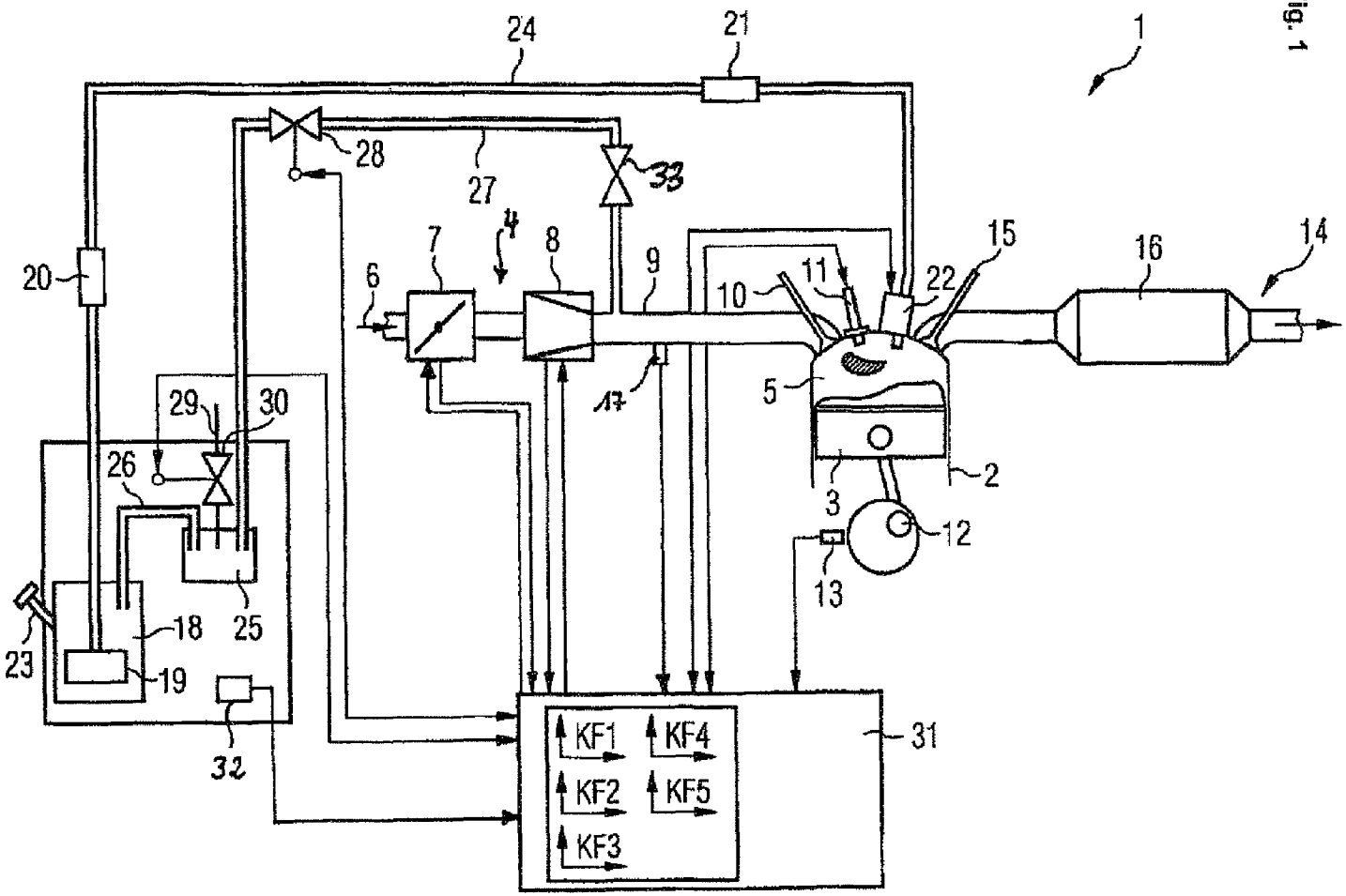
FIG. 1 is a schematic representation of a supercharged internal combustion engine having a tank venting apparatus.

A tank venting apparatus for a supercharged internal combustion engine according to claim 1 comprises a fuel tank and a fuel vapor reservoir, which is connected to the fuel tank by way of a connecting line and to an inlet manifold of the internal combustion engine by way of a venting line. The tank venting apparatus further comprises a tank venting valve, which is arranged in the venting line. The tank venting apparatus further comprises a safety valve, which is arranged in the venting line between the tank venting valve and the inlet manifold, the safety valve being designed in such a way that it permits a gas through-flow in a closing direction from the inlet manifold to the tank venting valve, until a specific excess pressure is reached in the inlet manifold relative to the pressure at the tank venting valve.

Unlike the tank venting apparatus known in the state of the art, the tank venting apparatus according to various embodiments comprises a safety valve, which also permits a gas flow in the direction of the tank venting valve until a specific excess pressure is reached in the inlet manifold. This means that with the internal combustion engine switched off, for example, pressure equalization between the inlet manifold and the tank venting apparatus can be achieved through opening of the tank venting valve (in the safety valves known in the state of the art, on the other hand, any gas flow from the inlet manifold in the direction of the tank venting valve is prevented). By establishing this pressure equalization, it is possible to verify, for the purpose of a leak test, that a pressure switch arranged in the tank venting apparatus is functioning. With regard to the precise procedure, reference will be made here to the description of the method in claim 2. However, since the safety valve permits the gas through-flow in the direction of the tank venting valve only until a specific excess pressure is reached in the inlet manifold relative to the pressure at the tank venting valve, but at a higher excess pressure prevents the gas though-flow in the direction of the tank venting valve, an adequate protection of the tank venting valve against excessive pressure loading is simultaneously ensured. The tank venting apparatus according to various embodiments consequently affords component protection of the tank venting valve and also other components of the tank venting apparatus. At the same time a function test on a pressure switch arranged in the tank venting apparatus is possible for the purpose of a leak test.

The subject matter of claim 2 is a method for controlling a supercharged internal combustion engine having a tank venting apparatus as claimed in claim 1. According to this, after switching off the internal combustion engine the tank venting valve is opened in such a way that pressure equalization is permitted between the fuel tank and the inlet manifold. The position of a pressure switch of the tank venting apparatus is registered, the switch being designed in such a way that on completion of pressure equalization between the fuel tank and the inlet manifold it is situated in a high-pressure switching position. A defect of the pressure switch will be identified if this is not situated in the high-pressure switching position after opening of the tank venting valve.

Performing this method in a supercharged internal combustion engine having a tank venting apparatus as claimed in claim 1 enables a function test on the pressure switch whilst the internal combustion engine is switched off. The pressure switch is designed in such a way that in a fault-free state it is situated in a high-pressure switching position, when the pressure in the tank venting apparatus is approximately at ambient pressure. Since with the internal combustion engine switched off, ambient pressure is established in the inlet manifold after a certain time, pressure equalization between the inlet manifold and the tank venting apparatus can be achieved through opening of the tank venting valve, since the safety valve designed in this way allows a gas through-flow from the inlet manifold via the opened tank venting valve into the tank and into the fuel vapor reservoir. If, after pressure equalization, the pressure switch is not situated in the high-pressure switching position, the pressure switch may be deemed to be defective.

In a development of the method as claimed in claim 3, a defect of the pressure switch is identified only if it is not situated in the high-pressure switching position once a predefined period of time has elapsed after opening of the tank venting valve.

The pressure equalization between the inlet manifold and the tank venting apparatus takes a certain time. In order to avoid misdiagnoses, the assessment of the serviceability of the pressure switch is only performed once a predefined period of time has elapsed after opening of the tank venting valve. In a development of the method as claimed in claim 4 the tank venting valve is not opened if the pressure switch is already situated in the high-pressure switching position prior to the opening of the tank venting valve.

If the pressure switch is already situated in the high-pressure switching position, a plausibility check on the serviceability of the pressure switch is firstly not possible, since switching into the high-pressure switching position can no longer be achieved once the tank venting valve has opened. Furthermore, it might be the case that an excess pressure prevails in the tank venting apparatus, so that on opening of the tank venting valve fuel vapors could get into the inlet manifold and therefore into the surroundings.

FIG. 1 represents an exemplary embodiment of a supercharged internal combustion engine 1. The internal combustion engine 1 comprises at least one cylinder 2 and a piston 3 moving up and down in the cylinder 2. The fresh air needed for combustion is introduced into a combustion chamber 5 defined by the cylinder 2 and the piston 3 via an intake tract 4. Situated downstream of an intake aperture 6 in the intake tract 4 are a throttle valve 7 for controlling the rate of air flow, a compressor 8 of a turbocharger or a compressor, an inlet manifold 9, an inlet manifold pressure sensor 17 and an inlet valve 10, which serves for selectively connecting the combustion chamber 5 to the intake tract 4 or separating it therefrom.

The combustion is initiated by means of a spark plug 11. The motive energy generated by the combustion is transmitted to the drivetrain of a motor vehicle (not shown) via a crankshaft 12. A rotational speed sensor 13 registers the speed of the internal combustion engine 1.

The combustion exhaust gases are discharged via an exhaust tract 14 of the internal combustion engine 1. The combustion chamber 5 is selectively connected to the exhaust tract 14 or separated therefrom by means of an exhaust valve 15. The exhaust gases are treated in an emission control catalytic converter 16.

A fuel supply system, comprising a fuel tank 18, a fuel pump 19, a high-pressure pump 20, a pressure accumulator 21 and at least one controllable injection valve 22, is furthermore assigned to the internal combustion engine 1. The fuel tank 18 comprises a sealable filler neck 23 for filling with fuel. The fuel is delivered to the injection valve 22 by means of the fuel pump 19 via a fuel feed line 24. The high-pressure pump and the pressure accumulator 21 are arranged in the fuel feed line 24. The function of the high-pressure pump 20 is to deliver the fuel at high pressure to the pressure accumulator 21. Here the pressure accumulator 21 is embodied as a common pressure accumulator 21 for all injection valves 22. From said accumulator all injection valves 22 are supplied with pressurized fuel. The internal combustion engine 1 in the exemplary embodiment is an engine having direct fuel injection, in which the fuel is injected directly into the combustion chamber 5 by means of an injection valve 22 projecting into the combustion chamber 5. It will be pointed out, however, that the present invention is not limited to this type of fuel injection, but can also be used on other types of fuel injection, such as inlet manifold injection, for example.

A tank venting apparatus is furthermore assigned to the internal combustion engine 1. Forming part of the tank venting apparatus is a fuel vapor reservoir 25, which is embodied as an activated charcoal vessel, for example, and is connected to the fuel tank 18 by way of a connecting line 26. The fuel vapors occurring in the fuel tank 18 are led into the fuel vapor reservoir 25 where they are adsorbed by the activated charcoal. The fuel vapor reservoir 25 is connected via a venting line 27 to the inlet manifold 9 of the internal combustion engine 1. Situated in the venting line 27 are a controllable tank venting valve 28 and a safety valve 33, the construction and operating principle of which will be further explained with reference to FIGS. 2 and 3. Fresh air can furthermore be delivered to the fuel vapor reservoir 25 via a ventilation line 29 and a controllable ventilation valve 30 optionally arranged therein. The tank venting apparatus comprises a pressure switch 32, which is designed in such a way that in the serviceable state it is situated in a high-pressure switching position, if the pressure in the tank venting apparatus is greater than a pressure threshold value, and is otherwise situated in a low-pressure switching position. The pressure threshold valve is typically 3 mbar less than the ambient pressure. In certain operating ranges of the internal combustion engine 1, particularly when idling or at partial load, a large negative pressure prevails in the inlet manifold 9 due to the strong throttling effect imparted by the throttle valve 7. Opening the tank venting valve and the ventilation valve 30 during a tank venting period therefore gives rise to a scavenging effect, in which the fuel vapors stored in the fuel vapor reservoir 25 are carried into the inlet manifold 9 and take part in the combustion. In this way the fuel vapor reservoir is regenerated.

A control device 31, in which mapped engine management functions (KF1 to KF5) are implemented in the form of software, is assigned to the internal combustion engine 1. The control device 31 is connected by way of signal and data leads to all actuators and sensors of the internal combustion engine 1. In particular the control device 31 is connected to the controllable ventilation valve 30, the controllable tank venting valve 28, the inlet manifold pressure sensor 17, the controllable throttle valve 7, the controllable injection valve 22, the spark plug 11, the engine speed sensor 13 and the pressure switch 32.

Figure 2:
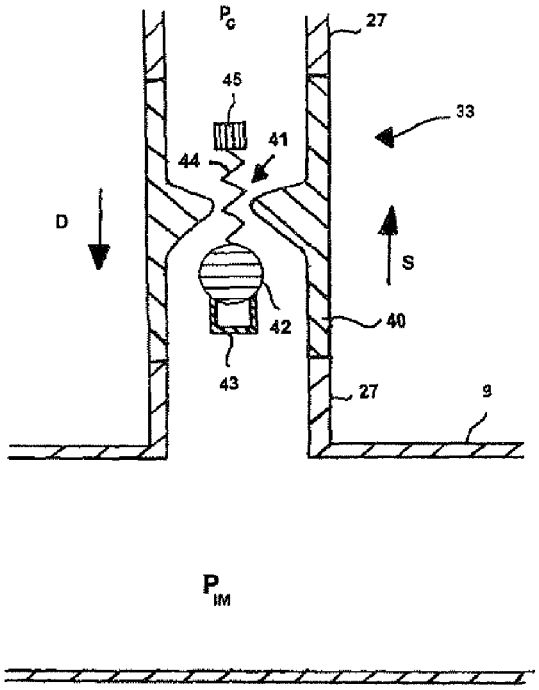
FIG. 2 is an exemplary embodiment of a safety valve of the tank venting apparatus.

FIG. 2 schematically represents an exemplary embodiment of the safety valve 33 and its arrangement in the venting line 27. The safety valve 33 has a housing 40, and is fitted inside the venting line 27. A middle portion of the housing 40 of the safety valve 33 is formed or curved in such a way that the flow cross section has a circular constriction 41. Inside the flow cross section the safety valve 33 comprises a moveable stopper element 42 (embodied as a spherical ball element in the exemplary embodiment), a stopper element seat 43, a spring 44 and a spring anchorage 45, which is firmly connected to the housing 40 of the safety valve 33. The spring 44 is firmly connected on one side to the spring anchorage 45, and on the other side to the stopper element 42. Here the spring force acts in such a way that the stopper element 42 is pressed into the stopper element seat 43. The geometry of the stopper element 42 is selected in such a way that if the stopper element 42 is pressed against the spring force onto the constriction 41 in the flow cross section formed by the housing 40 of the safety valve 33, the flow cross section is completely sealed, so that a gas through-flow is no longer possible.

In FIG. 2 the pressure in the inlet manifold 9 is denoted by the reference character $P_{IM}$, the pressure at the tank venting valve 28 by the reference character $P_C$. The arrow S furthermore denotes the closing direction of the safety valve 33 from the inlet manifold 9 to the tank venting valve 28. The arrow D denotes the passage direction of the check valve 33 from the tank venting valve 28 to the inlet manifold 9.

Figure 3:
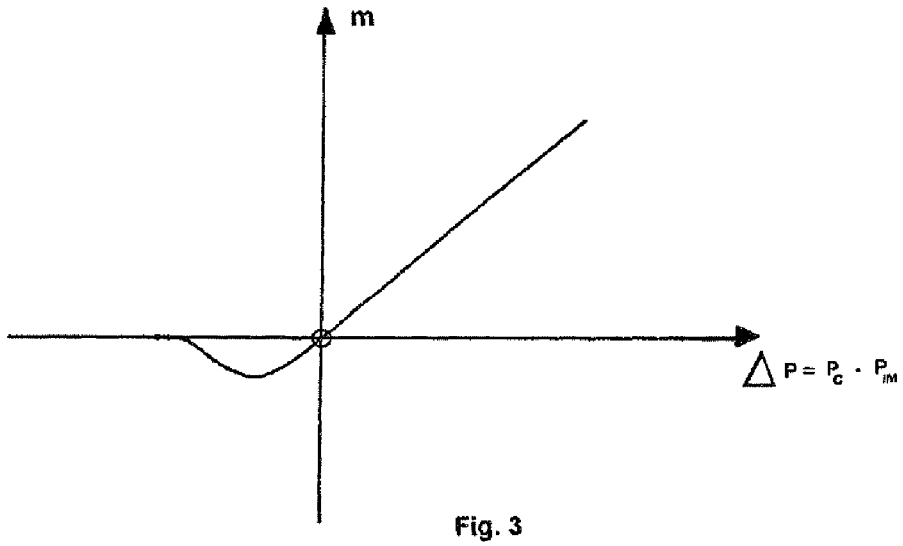
FIG. 3 is a schematic characteristic curve of the safety valve.

In FIG. 3 the characteristic curve of the check valve shown in FIG. 2 is represented schematically. In the diagram the gas through-flow through the check valve 33 is represented against the pressure differential ΔP between the pressure $P_C$ at the tank venting valve 28 and the pressure $P_{IM}$ in the inlet manifold. As can be seen, in the case of a positive pressure differential (pressure $P_C$ at the tank venting valve 28 is greater than the pressure $P_{IM}$ in the inlet manifold 9) a gas through-flow ensues through the safety valve in the passage direction D. Since in this case the pressure $P_C$ at the tank venting valve 28 is greater than the pressure $P_{IM}$ in the inlet manifold 9, the stopper element is pressed into the stopper element seat 43 due to the pressure gradient from the tank venting valve 28 to the inlet manifold 9 and in addition by the spring force of the spring 44. The flow cross section in the safety valve 33 is thereby opened and gas is able to flow in the passage direction from the tank venting valve 28 to the inlet manifold 9. Under these pressure conditions, that is to say given a sufficient negative pressure in the inlet manifold 9 relative to the pressure in the tank venting apparatus, a tank venting operation is possible through opening of the tank venting valve 28.

As is further apparent from FIG. 2, in the event of a pressure differential ΔP=0 the gas flow through the safety valve 33 is also m=0.

In the case of a negative pressure differential ΔP (pressure $P_C$ at the tank venting valve 28 is less than the pressure $P_{IM}$ in the inlet manifold 9), a force acts on the stopper element 42 in opposition to the spring force, due to the pressure gradient from the inlet manifold 9 to the tank venting valve 28. The spring 44 is designed in such a way that a gas through-flow through the check valve 33 in the closing direction S is possible until a specific excess pressure in the inlet manifold is reached relative to the pressure $P_C$ at the tank venting valve 28. If the pressure $P_{IM}$ in the inlet manifold 9 continues to rise relative to the pressure $P_C$ at the tank venting valve 28, the force acting on the stopper element in opposition to the spring force will also continue to rise. From a specific excess pressure onwards in the inlet manifold, relative to the pressure at the tank venting valve 28, the force acting on the stopper element 42 is greater than the spring force, so that this is pressed onto the constriction 41 of the flow cross section of the safety valve 33, sealing the latter. From this time onwards a through-flow through the check valve 33 in the closing direction S is no longer possible.

A gas through-flow through the safety valve according to various embodiments in the closing direction S is therefore possible up to a certain excess pressure in the inlet manifold 9 relative to the pressure at the tank venting valve 28. If the excess pressure in the inlet manifold 9, relative to the pressure at the tank venting valve 28, rises beyond this, the safety valve 33 closes the flow cross section and a gas through-flow from the inlet manifold 9 in the direction of the tank venting valve 28 (closing direction S) is prevented. In the event of excessive pressure in the inlet manifold 9, the tank venting valve 28 is thereby reliably protected against damage. In the event of a slight excess pressure in the inlet manifold 9 relative to the pressure at the tank venting valve 28, pressure equalization between the inlet manifold and the tank venting apparatus can ensue through opening of the tank venting valve 28.

Figure 4:
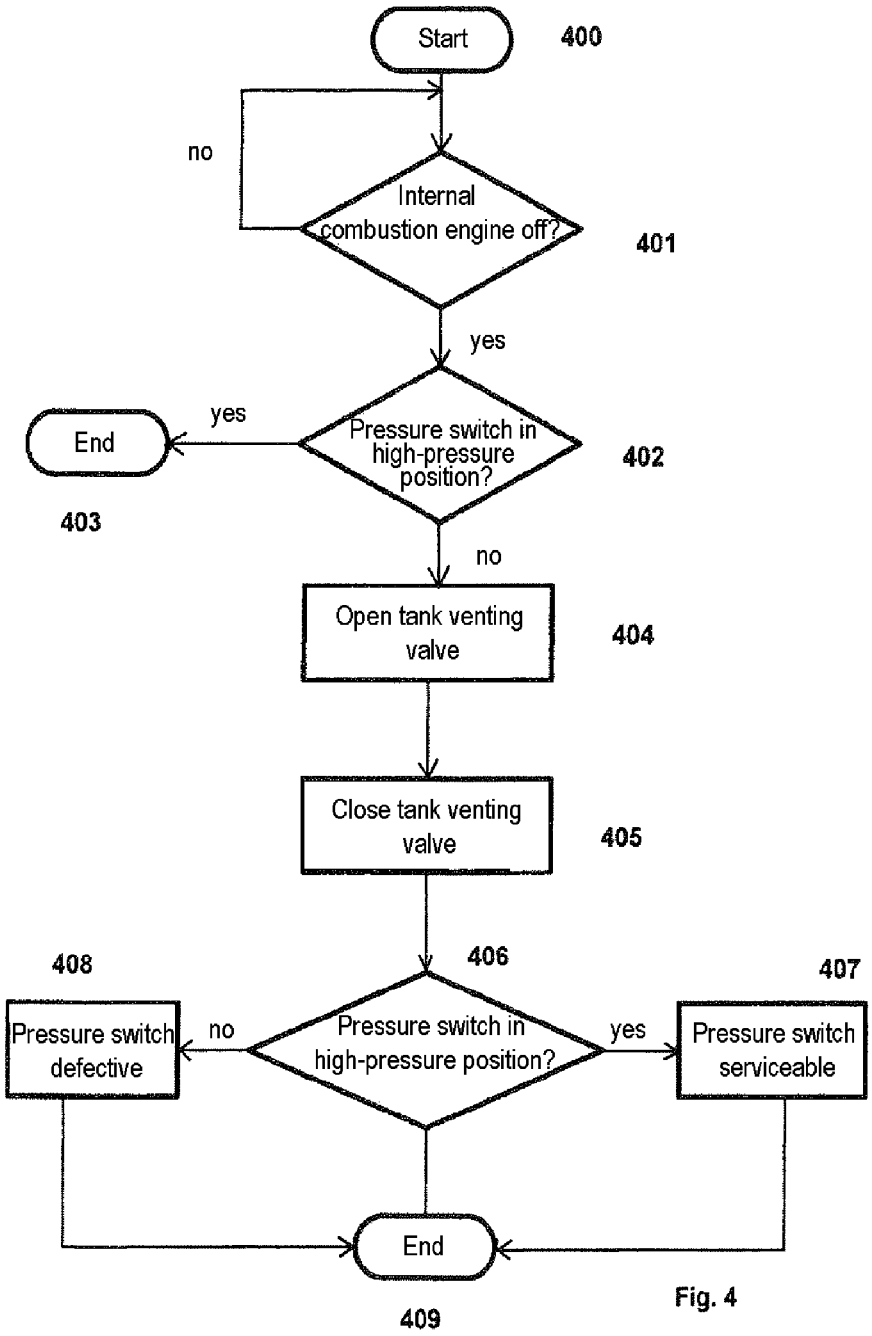
FIG. 4 is an exemplary embodiment of a control method in the form of a flow chart.

An exemplary embodiment of a control method for the supercharged internal combustion engine 1 having the tank venting apparatus according to various embodiments (see FIG. 1) will be explained with reference to FIG. 4.

The method starts at step 400, for example on starting the internal combustion engine 1. In step 401, a check is performed as to whether the internal combustion engine 1 is switched off. If this is not the case, that is to say the internal combustion engine remains in operation, the query is repeated. If it is detected in step 401, however, that the internal combustion engine 1 has been switched off, the method progresses with step 402, in which a check is performed as to whether the pressure switch 32 of the tank venting apparatus is situated in the high-pressure switching position. If this is the case, the method is terminated with step 403. This serves to prevent fuel vapors getting into the intake tract 4 and into the surroundings due to opening of the tank venting valve 28.

If, however, it is detected in step 402 that the pressure switch 32 is not situated in the high-pressure switching position but in the low-pressure switching position, the method progresses with step 404, in which the tank venting valve 28 is opened once a certain time has elapsed after switching off the internal combustion engine 1. When the internal combustion engine has been switched off and the certain period of time has elapsed, ambient pressure substantially prevails in the inlet manifold 9. Since the pressure switch 32 of the tank venting apparatus is situated in the low-pressure switching position, a pressure which is less than ambient pressure prevails in the tank venting apparatus. Consequently a higher pressure $P_{IM}$ prevails in the inlet manifold 9 than in the tank venting apparatus. Due to the opening of the tank venting valve 28, the pressure $P_C$ at the tank venting valve 28 assumes substantially the value of the pressure in the fuel tank 19 or in the fuel vapor reservoir 25, so that the pressure $P_c$ at the tank venting valve is lower than the pressure $P_{IM}$ in the inlet manifold or the ambient pressure. An excess pressure therefore prevails in the inlet manifold 9 relative to the pressure $P_C$ at the tank venting valve and the pressure in the tank venting apparatus (fuel tank and fuel vapor reservoir). If this excess pressure is less than the specific excess pressure explained with reference to FIG. 3, up to which the safety valve 33 allows a gas flow in the closing direction, the flow cross section 41 at the safety valve 33 is opened and pressure equalization occurs between the inlet manifold 9 and the tank venting apparatus. This means that once a certain time has elapsed after opening of the tank venting valve 28 ambient pressure is established throughout the tank venting apparatus.

Once a predefined period of time has elapsed after opening of the tank venting valve 28, this is closed in step 405.

The method progresses with step 406, in which the position of the pressure switch 32 is checked. If it is detected that the pressure switch 32 is now situated in the high-pressure switching position, this is deemed to be serviceable in step 406. The opening of the tank venting valve 28 and the resulting pressure equalization between the inlet manifold 9 and the tank venting apparatus means that ambient pressure now prevails in said apparatus, so that the pressure switch 32 in the serviceable state must be situated in the high-pressure switching position.

If, on the other hand, it is detected in step 406 that the pressure switch 32 is not in the high-pressure switching position but in the low-pressure switching position, in step 407 the pressure switch is deemed to be defective. In this case an entry may be made in the fault memory, for example, and/or a warning signal may be emitted to the vehicle driver. Following the steps 408 or step 407 the method is terminated with step 409.

The tank venting apparatus and the control method according to various embodiments allow a diagnosis of the serviceability of the pressure switch 32 of the tank venting apparatus even in supercharged internal combustion engines 1. This is attributable, in particular, to the special design of the safety valve 33, which permits pressure equalization between the inlet manifold 9 and the tank venting apparatus whilst the internal combustion engine 1 is switched off. At the same time the special design of the safety valve 33 serves to prevent the tank venting valve 28 being protected against damage whilst the internal combustion engine 1 is operating in the supercharged operating range (pressure in the inlet manifold $P_{IN}$ is substantially greater than ambient pressure).

What is claimed is:

1. A tank venting apparatus for a supercharged internal combustion engine, comprising a fuel tank, a fuel vapor reservoir connected to the fuel tank by a connecting line and to an inlet manifold of the internal combustion engine by a venting line, a tank venting valve arranged in the venting line, and a safety valve arranged in the venting line between the tank venting valve and the inlet manifold, the safety valve configured to:

permit gas flow in an opening direction of the safety valve from the tank venting valve to the inlet manifold when a pressure at the tank venting valve exceeds a pressure at the inlet manifold, permit gas flow in a closing direction of the safety valve from the inlet manifold to the tank venting valve when the pressure at the tank venting valve exceeds the pressure at the inlet manifold by an amount more than zero but less than a predefined amount that closes the safety valve, and close in response to the pressure at the tank venting valve exceeding the pressure at the inlet manifold by more than the predefined amount, thereby preventing gas flow in the closing direction.

2. The tank venting apparatus according to claim 1, further comprising a control device being configured to after switching off the internal combustion engine, to open the tank venting valve to permit pressure equalization between the fuel tank and the inlet manifold, to register the position of a pressure switch, wherein the switch is situated in a high-pressure switching position on completion of pressure equalization between the fuel tank and the inlet manifold, and to detect a defect of the pressure switch if the pressure switch is not situated in the high-pressure switching position after opening of the tank venting valve.

3. The tank venting apparatus according to claim 2, wherein the control device identifies a defect of the pressure switch only if it is not situated in the high-pressure switching position once a predefined period of time has elapsed following opening of the tank venting valve.

4. The tank venting apparatus according to claim 2, wherein the control device does not open the tank venting valve if the pressure switch is already situated in the high-pressure switching position prior to opening of the tank venting valve.

5. The tank venting apparatus according to claim 3, wherein the control device does not open the tank venting valve if the pressure switch is already situated in the high-pressure switching position prior to opening of the tank venting valve.

6. The tank venting apparatus according to claim 2, wherein the control device comprises mapped engine management functions implemented by software.

7. The tank venting apparatus according to claim 1, wherein the safety valve comprises a housing having a middle portion which is formed or curved to define a circular constriction of a cross-section of the gas flow.

8. The tank venting apparatus according to claim 7, wherein inside the gas flow cross-section the safety valve comprises a moveable stopper element, a stopper element seat, a spring and a spring anchorage, which is firmly connected to the housing of the safety valve.

9. The tank venting apparatus according to claim 8, wherein the moveable stopper element is embodied as a spherical hall element.

10. The tank venting apparatus according to claim 8, wherein the spring is firmly connected on one side to the spring anchorage, and on the other side to the stopper element, wherein the spring provides a spring force that presses the stopper element into the stopper element seat.

11. The tank venting apparatus according to claim 10, wherein a geometry of the stopper element is configured to completely seal the gas flow cross-section when the stopper element is pressed against the spring force onto a constriction in the gas flow cross-section formed by the housing of the safety valve thereby preventing a gas through-flow.

12. A method for controlling a supercharged internal combustion engine having a tank venting apparatus comprising:

a fuel tank, a fuel vapor reservoir, which is connected to the fuel tank by way of a connecting line and to an inlet manifold of the internal combustion engine by way of a venting line, a tank venting valve, which is arranged in the venting line, and a safety valve, which is arranged in the venting line between the tank venting valve and the inlet manifold, the safety valve configured to:

permit gas flow in an opening direction of the safety valve from the tank venting valve to the inlet manifold when a pressure at the tank venting valve exceeds a pressure at the inlet manifold, permit gas flow in a closing direction of the safety valve from the inlet manifold to the tank venting valve when the pressure at the tank venting valve exceeds the pressure at the inlet manifold by an amount more than zero but less than a predefined amount that doses the safety valve, and close in response to the pressure at the tank venting valve exceeding the pressure at the inlet manifold by more than the predefined amount, thereby preventing gas flow in the closing direction, wherein the method comprises:

after switching off the internal combustion engine, opening the tank venting valve to permit pressure equalization between the fuel tank and the inlet manifold, registering a position of a pressure switch, wherein the pressure switch is situated in a high-pressure switching position on completion of pressure equalization between the fuel tank and the inlet manifold, and detecting a defect of the pressure switch if the pressure switch is not situated in the high-pressure switching position after opening of the tank venting valve.

13. The method according to claim 12, wherein a defect of the pressure switch is identified only if it is not situated in the high-pressure switching position once a predefined period of time has elapsed following opening of the tank venting valve.

14. The method according to claim 12, wherein the tank venting valve is not opened if the pressure switch is already situated in the high-pressure switching position prior to opening of the tank venting valve.

15. The method according to claim 13, wherein the tank venting valve is not opened if the pressure switch is already situated in the high-pressure switching position prior to opening of the tank venting valve.

* * * * *